US012721437B2

(12) United States Patent
Sawyer et al.

(10) Patent No.: US 12,721,437 B2
(45) Date of Patent: Sep. 1, 2026

(54) LOAD DISPERSING FURNITURE SUPPORT FOR TURF APPLICATIONS

(71) Applicant: Brock USA, LLC, Boulder, CO (US)

(72) Inventors: Daniel C. Sawyer, Boulder, CO (US); John Shaffer, New Cumberland, PA (US); Daniel J. Dodd, Tega Cay, SC (US)

(73) Assignee: BROCK USA, LLC, Chattanooga, TN (US)

( * ) Notice: Subject to any disclaimer, the term of this patent is extended or adjusted under 35 U.S.C. 154(b) by 91 days.

(21) Appl. No.: 18/382,252

(22) Filed: Oct. 20, 2023

(65) Prior Publication Data

US 2024/0130525 A1 Apr. 25, 2024
US 2024/0225276 A9 Jul. 11, 2024

Related U.S. Application Data

(60) Provisional application No. 63/417,884, filed on Oct. 20, 2022.

(51) Int. Cl.
*A47B 91/00* (2006.01)

(52) U.S. Cl.
CPC ..... *A47B 91/005* (2013.01)

(58) Field of Classification Search
None
See application file for complete search history.

(56) References Cited

U.S. PATENT DOCUMENTS

| | | | | |
|---|---|---|---|---|
| 878,043 | A * | 2/1908 | Chrisman | F16F 1/3615 297/130 |
| 5,333,825 | A * | 8/1994 | Christensen | A47C 7/002 248/346.03 |
| 5,899,422 | A * | 5/1999 | Eke | A47C 7/002 248/188.7 |
| 8,407,855 | B2 | 4/2013 | Gagnon | |
| 10,895,044 | B2 | 1/2021 | Penland et al. | |
| 11,033,110 | B2 * | 6/2021 | Schellenberg | A61G 5/10 |
| 2004/0173996 | A1 * | 9/2004 | Anderson | B62B 5/0083 280/651 |
| 2007/0221800 | A1 * | 9/2007 | Levin | A47C 3/38 5/509.1 |
| 2014/0167482 | A1 * | 6/2014 | Myre | A47C 7/002 297/463.1 |
| 2014/0203619 | A1 * | 7/2014 | Dapra | A47C 7/008 297/463.1 |
| 2017/0107725 | A1 | 4/2017 | Jones et al. | |

* cited by examiner

*Primary Examiner* — Steven M Marsh
(74) *Attorney, Agent, or Firm* — McAndrews Held & Malloy, Ltd.

(57) ABSTRACT

A support platform for a furniture unit includes a plurality of support arms that each terminate in a corner pocket. The corner pocket supports a furniture leg end and contains the leg end within the platform perimeter. The platform defines a foundation support surface that may include cleats or anti-skid cushion pads to enhance friction with the foundation surface.

33 Claims, 16 Drawing Sheets

LOAD DISPERSING FURNITURE SUPPORT FOR TURF APPLICATIONS

CROSS-REFERENCE TO RELATED APPLICATIONS

This application claims the benefit of U.S. Provisional Application No. 63/417,884, filed Oct. 20, 2022, the disclosure of which is incorporated herein by reference in its entirety.

BACKGROUND OF THE INVENTION

This invention relates in general to load dispersing structures, such as furniture mats, as exemplified by chair mats or table mats, that protect underlying surfaces from concentrated loads. In particular, this invention relates to a load dispersing mat suitable for use in an outdoor environment and applied over turf (natural or artificial) or sand/soil substrates.

When schools hold graduation ceremonies, many times they are held on athletic fields with folding chairs provided for attendees. The problem lies in the point load pressures on the surface of the fields. If the field is natural grass, the chairs press into the grass and ruin the turf surface creating divots. Similar issues arise with artificial turf installations. Once set up, the chairs can become unstable and tip over because of the soft and displaceable nature of the surfaces. A typical solution is to use a concert decking to cover the field before arranging the chairs. The decking is very heavy and expensive, usually covers the entire seating area surface, and requires machines and manpower to install. For a natural grass surfaces, the decking should only be installed for a limited time period since it prevents sunlight from reaching the grass. The decking panels are also not designed to be used individually, and they don't "nest" for stacking efficiently. Thus, what is needed is a platform configured for supporting single units, such as folding chairs and tables, that are lightweight, provide for easy handling, and provide stable support.

SUMMARY OF THE INVENTION

This invention relates to a portable base for spreading point loads from furniture applied to a turf surface. In particular, this invention relates to a furniture support configured for a single furniture unit that is lightweight, stackable, and provides stable support.

In one embodiment, a portable, lightweight and strong platform is designed to accept various configurations of chairs and spreads the concentrated loads from the legs or other contact structures and protects the turf surface. The platforms are stackable, and have a handle so they are easy to grab by an individual. The invention also provides greater stability for better safety for the user. They can be produced by any variety of forming methods, such as injection molding, steam chest molding, thermoforming, roto-molding, or die cut and molded from sheet stock. The materials may include plastics, such as HDPE, PP, recycled plastics, high density foams, etc. The panels can be configured to clip or fasten together to aid in alignment of seating rows or be used individually. In certain embodiments, the bottom of the platforms, particularly in areas proximate to the point load application position, may include cleats or other higher friction surfaces to prevent sliding. The platforms may further include ridges and/or varying material thicknesses to create stiffness and load spreading where needed to prevent the chair feet from sinking.

In certain embodiments, the platforms may include tie-downs, such as hook-and-loop straps or clips, to secure the chair frames or legs to the platform. The platforms may include reinforcing gussets to provide a stiffness characteristic to the structure in the form of increased bending resistance to loads applied by the furniture to the corner pockets. The layout of support arms and corner pockets of the support surface permits more turf to be exposed, thus minimizing damage to the surface.

In certain embodiments, a furniture support platform has a plurality of support arms extending from a central point, an upper surface, and a foundation surface. The plurality of support arms each terminate in a corner pocket configured to support a furniture leg. The plurality of support arms have a reinforcement cross section defining a stiffness characteristic. The foundation surface is positioned opposite to the upper surface and configured to support an article of furniture on a base surface. The stiffness characteristic maintains the foundation surface in a generally planar orientation in response to the load applied by the furniture. The stiffness characteristic of the reinforcement cross section resists bending of the corner pockets into the base surface, particularly where the base surface is soft and deformable, such as natural grass, artificial turf, or a sandy surface such as a beach.

In certain embodiments of the invention, the reinforcement cross section of the plurality of support arms is configured as a perimeter gusset extending around the plurality of support arms and defining the upper surface. The perimeter gusset may be a plurality of generally concentric reinforcing gussets configured to resist bending of the support arms. Alternatively, the perimeter gusset may be a generally straight wall extending from or extending adjacent to the upper surface. The perimeter gusset may terminate in flange. The reinforcement cross section of the support arms may alternatively be configured as one of an arched, crowned or flat profile.

Certain embodiments may include a stiffening member connected between adjacent support arms and may define a handle. In alternative embodiments, the foundation surface may extend along a perimeter of the plurality of support arms and define a hollow section of the upper surface configured as an arched or crowned profile. The support arms may be fixed or variable in length and/or angular orientation around the center point. The center point may be configured as a hub that attaches to the plurality of support arms. In certain embodiments, the plurality of support arms may angularly or circumferentially moveable about the hub.

The corner pockets of the support arms may include one or more cushioning pads to prevent marring of the base surface. The corner pockets may alternatively include a textured surface on the foundation surface that engages the base surface. In conjunction with or as a separate configuration thereof, the corner pockets may include a textured surface that engages the furniture leg.

A furniture support platform has a plurality of support arms extending from a central point. The plurality of support arms each terminate in a corner pocket configured to support a furniture leg. An upper surface of the support platform defines a portion of a reinforcement cross section of the plurality of support arms. The reinforcement cross section defines a stiffness characteristic that resists deflection of the corner pockets. A foundation surface, positioned opposite the upper surface, is configured to support an article of furniture on a base surface. The base surface may be one of a turf structure or a sand structure and the stiffness characteristic resists deflection of the corner pockets into the turf or sand. A handle may extend between two adjacent support arms and have greater flexibility than provided by the stiffness characteristic. This prevents handle breakage if it is stepped on. The corner pockets may include fasteners that permit one furniture support platform to be connected to an adjacent furniture support platform. The fasteners may be configured as mating dovetail projections and recesses. There may be a tiedown connected between either the handle, a stiffening member, or the support arm to prevent the article of furniture from moving relative to the support platform.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
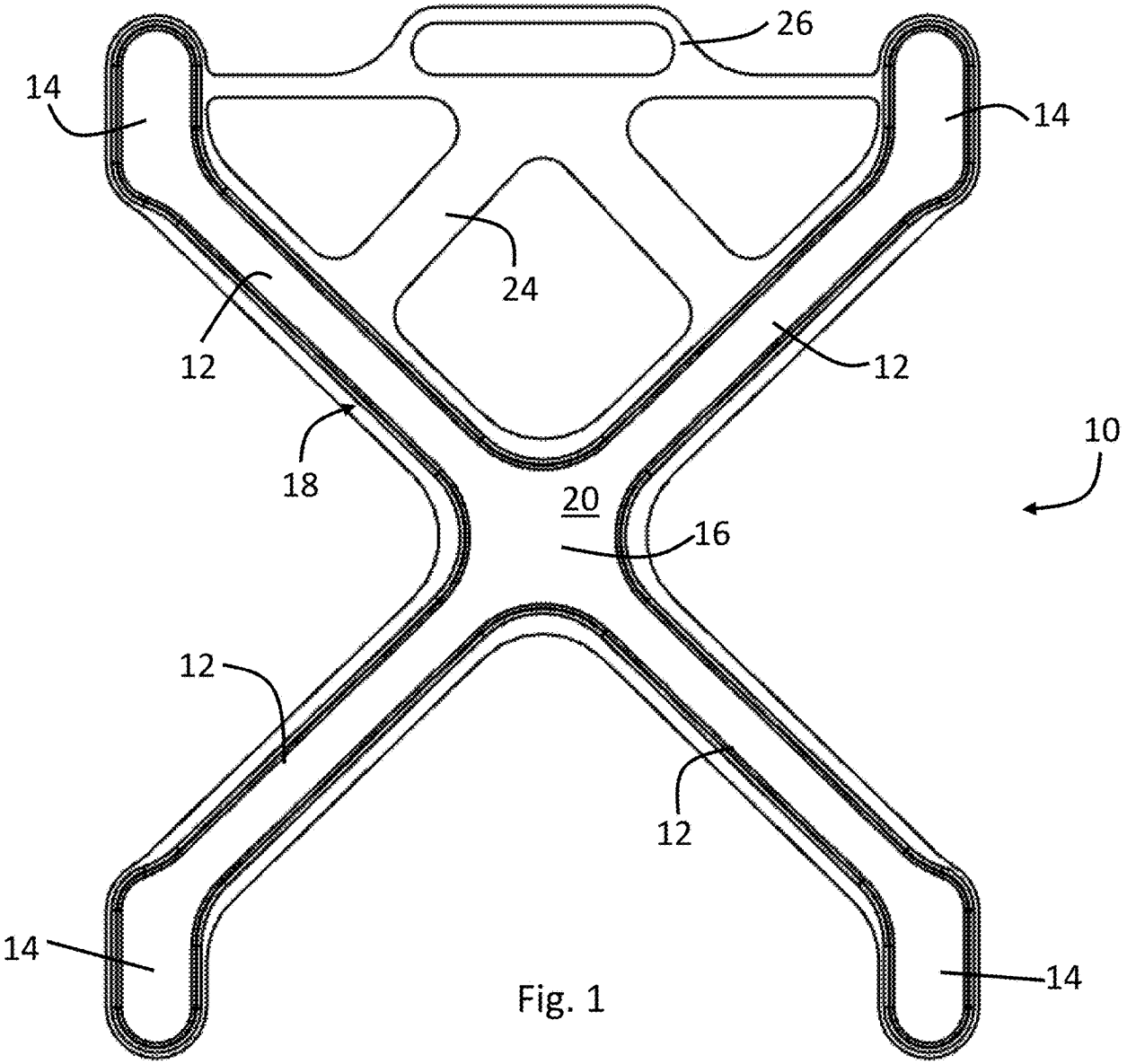
FIG. 1 is a plan view of an embodiment of a support platform in accordance with the invention.
Figure 3A:
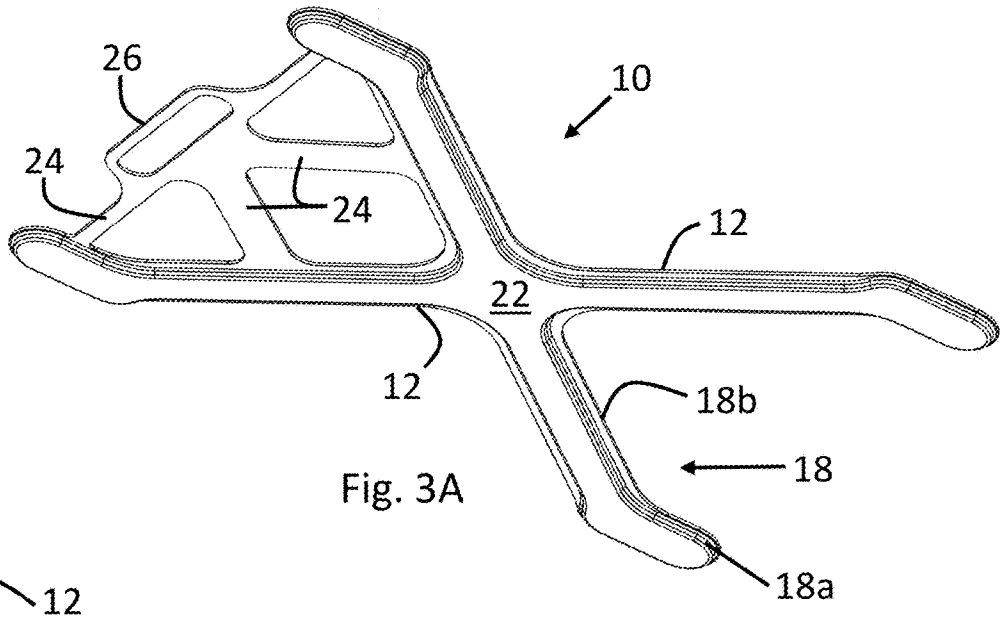
FIG. 3A is a perspective view of an underside of the platform of FIG. 2.
Figure 3B:
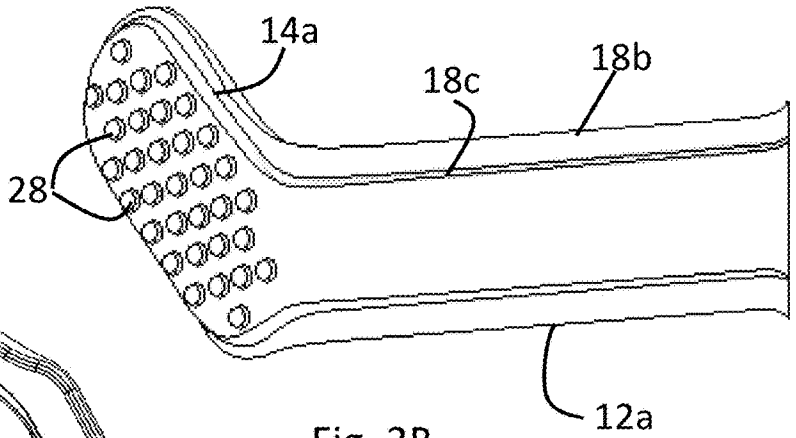
FIG. 3B is an alternative embodiment of the platform of FIG. 3A that includes a high friction turf contact surface.
Figure 2:
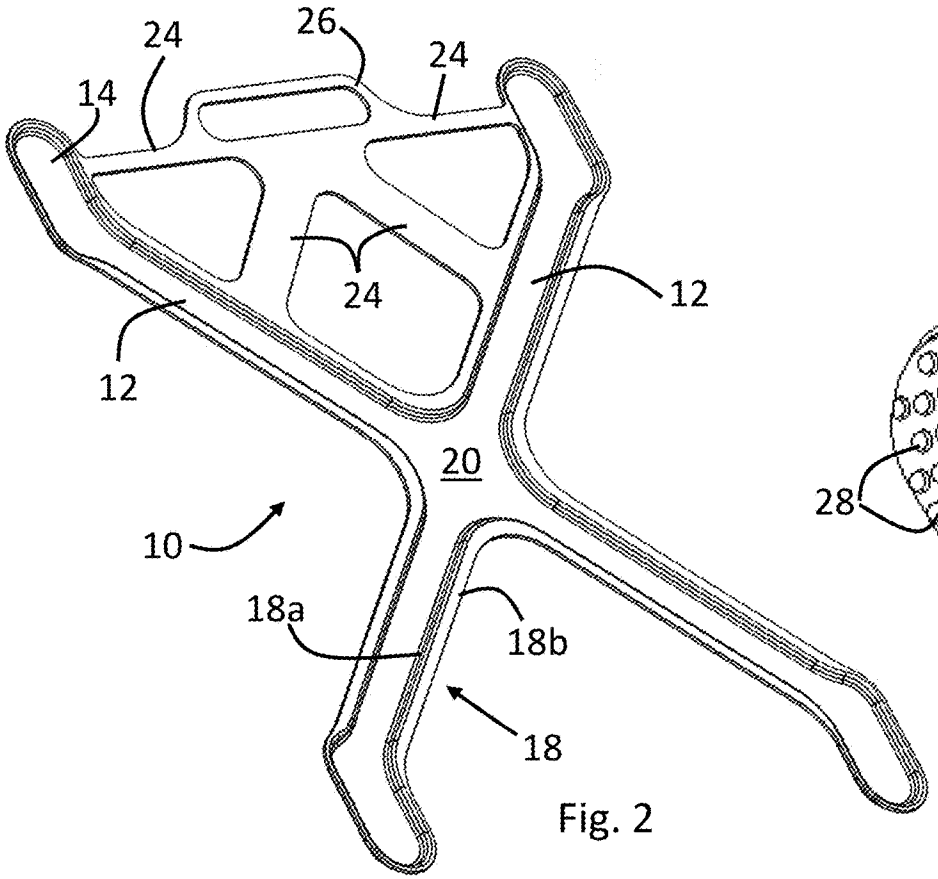
FIG. 2 is a perspective view of the platform of FIG. 1 showing ridge stiffeners defining containment contours.

Referring now to the drawings, there is illustrated in FIGS. 1 and 2 a furniture support platform shown generally at 10. While illustrated as a platform configured to support rectangularly arranged furniture contact points, such as a folding chair or table, other geometric patterns, such as square, round, octagon, etc. are also contemplated. The support platform 10 includes support arms 12 that terminate in corner pockets 14, In certain embodiments, the support arms 12 may extend from a central point 16, though such is not required. The support arms 12 and corner pockets 14 may be reinforced by a perimeter gusset 18 that defines a contact tray or surface 20. The contact tray 20 defines an upper surface that forms a support for furniture placed thereon and a foundation surface 22 that contacts a base, such as turf, flooring, or other surface supporting the furniture, defining an underside of the platform is shown in FIG. 3A. The perimeter gussets 18 define a stiffness characteristic that resists bending of the support arms 12 from loads applied by the furniture. The perimeter gussets 18 are illustrated as ridge stiffening members. In one embodiment, the perimeter gusset 18 is illustrated having a stepped structure 18*a*, embodied as concentric perimeter gussets that terminate in a stiffening flange 18*b*. Alternatively, as discussed below, the perimeter gusset may have a straight wall section that extends at an angle between the flange 18*b* and the foundation surface 22. In the illustrated embodiment of FIG. 3B, the perimeter gusset includes a straight wall 18*c*, oriented at an outwardly extending taper between the foundation surface 22 and the flange 18*b*. This permits the platforms 10 to be stacked on top of each other without creating a shifting pile that is difficult to move. The support platform 10 may also include stiffening members 24 that connect portions of the platform together to add to a rigid and stable structure. In alternative embodiments, the platform may have a degree of flex or elasticity to permit contact over uneven surfaces. The stiffening members 24 may also define a handle 26 to aid in moving, collecting, and stacking the platforms. Though shown applied between two adjacent arms 12 and corner pockets 14, the stiffening members 24 and/or handle 26 may be applied between any two arms or all arms if so desired. As shown in FIG. 3B, an alternative embodiment shown as corner pocket 14*a* may include one or more cleats 28 extending from the underside. Though not shown, cleats 28 may also extend from arms 12*a*. The cleats 28 may be molded with or otherwise formed into the platform or applied and attached thereto. The cleats 28 provide frictional engagement with the base, such as a turf base, to prevent inadvertent movement.

Figure 4:
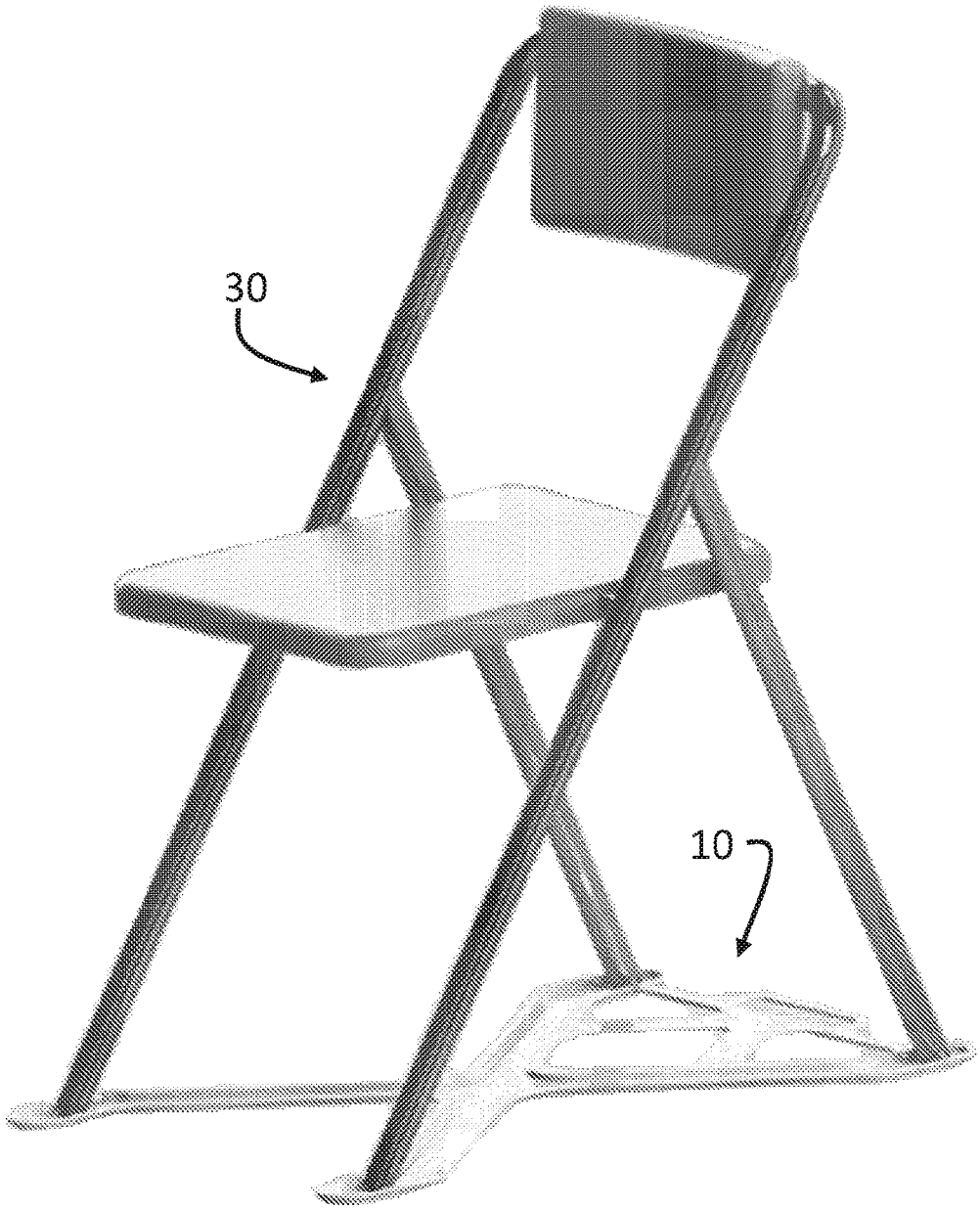
FIG. 4 is an exploded assembly view of the platform of FIG. 1 and a four-legged folding chair example showing placement of load points.
Figure 5:
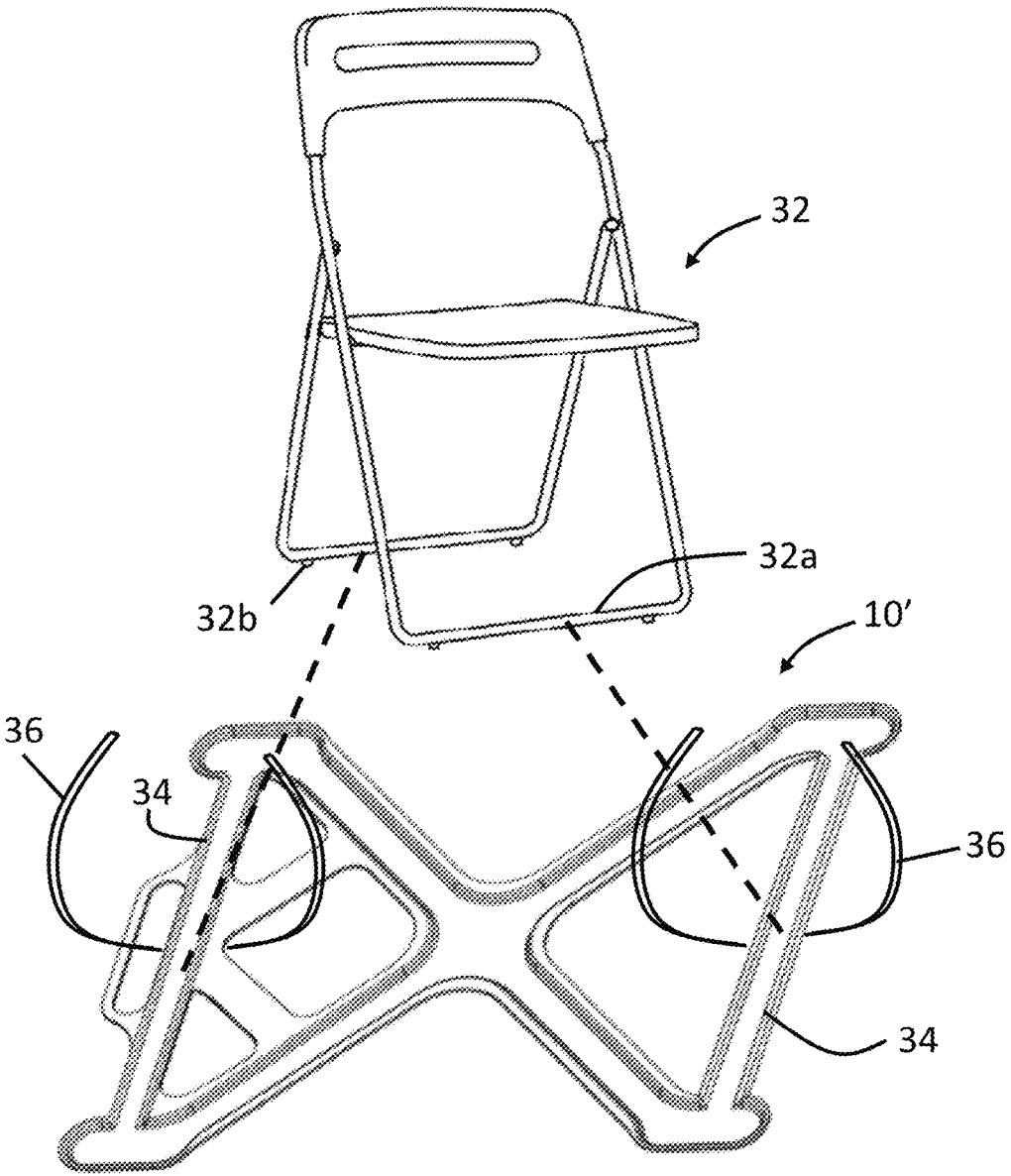
FIG. 5 is an alternative embodiment of a platform configured for a bow-formed seat frame and includes tied-down elements.

Referring now to FIGS. 4 and 5, an exemplar furniture piece, such as a folding chair 30 or 32, is shown positioned over the platform 10 or 10'. The platform 10' is configured to support chair 32 having hoop-formed bases 32*a* or inboard-positioned contact points 32*b* rather than individual legs. The platform 10' includes a transverse support 34 that spans between two corner pockets to capture and support the chair base. The platform 10 and/or 10' may include a tiedown 36, illustrated as a hook-and-loop strap or other securing means to clip the chair to the platform. Alternatively, a clip may be formed into or attached onto the platform to capture a portion of a furniture support leg or hoop or a tiedown member.

Figure 6:
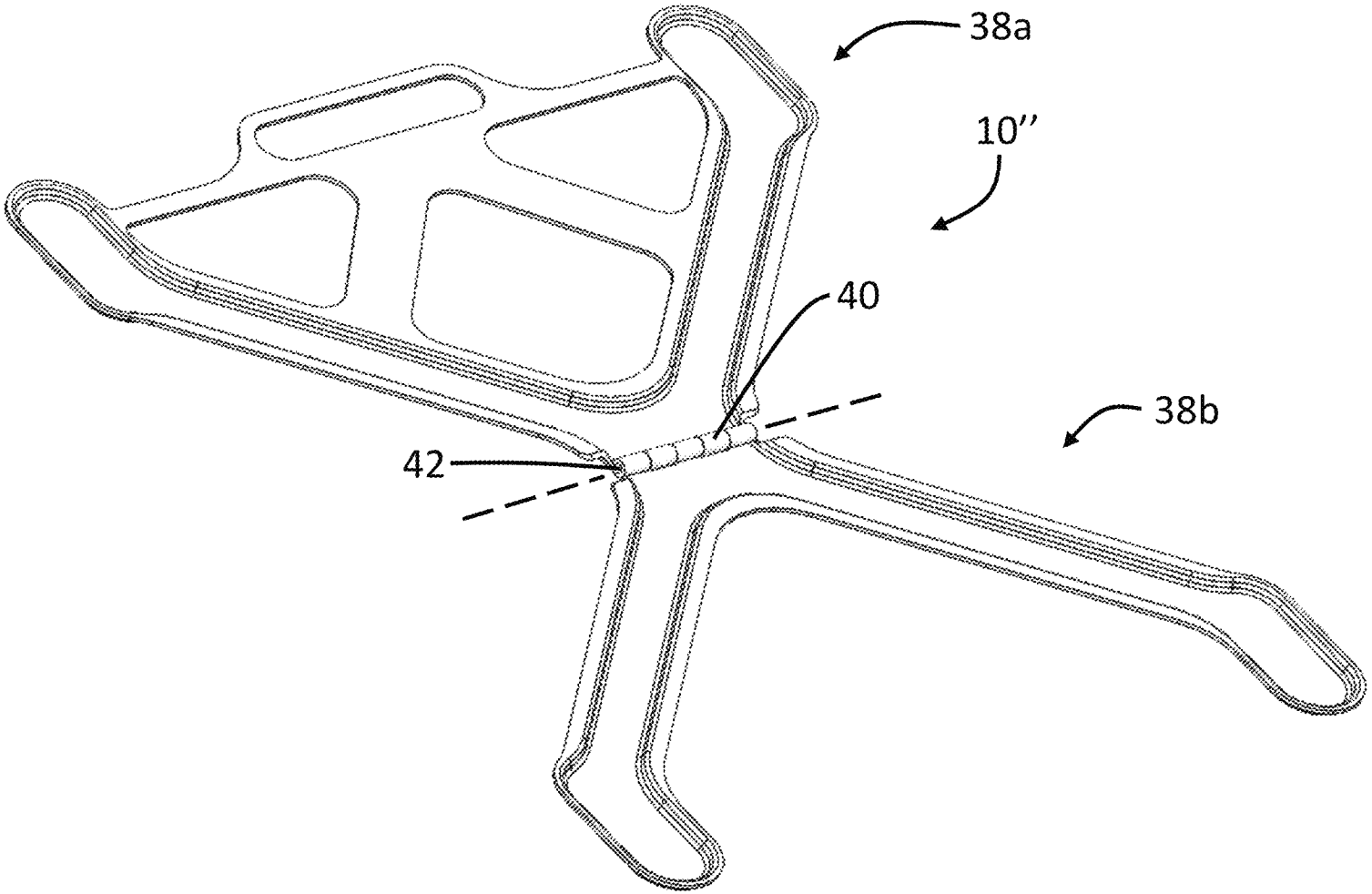
FIG. 6 is an alternative embodiment of a foldable platform in accordance with the invention.

In another embodiment shown in FIG. 6, platform 10" may be configured as two sections 38*a* and 38*b* connected together by a foldable mechanism 40 such as a hinge or living hinge. The mechanism may further have a hinge or pin axis 42 that defines a folding plane. The hinge 40 may be configured to permit the two sections 38*a* and 38*b* to move relative to each other along the axis 42 between an open position where the sections are laid out in the deployed state ready to accept a furniture unit and a closed position where the sections are folded for storage. In the open position, the sections 38*a* and 38*b* may be locked or otherwise fixed in position by the hinge 40, a latch, or other means to selectively prevent or permit folding.

Figure 7A:
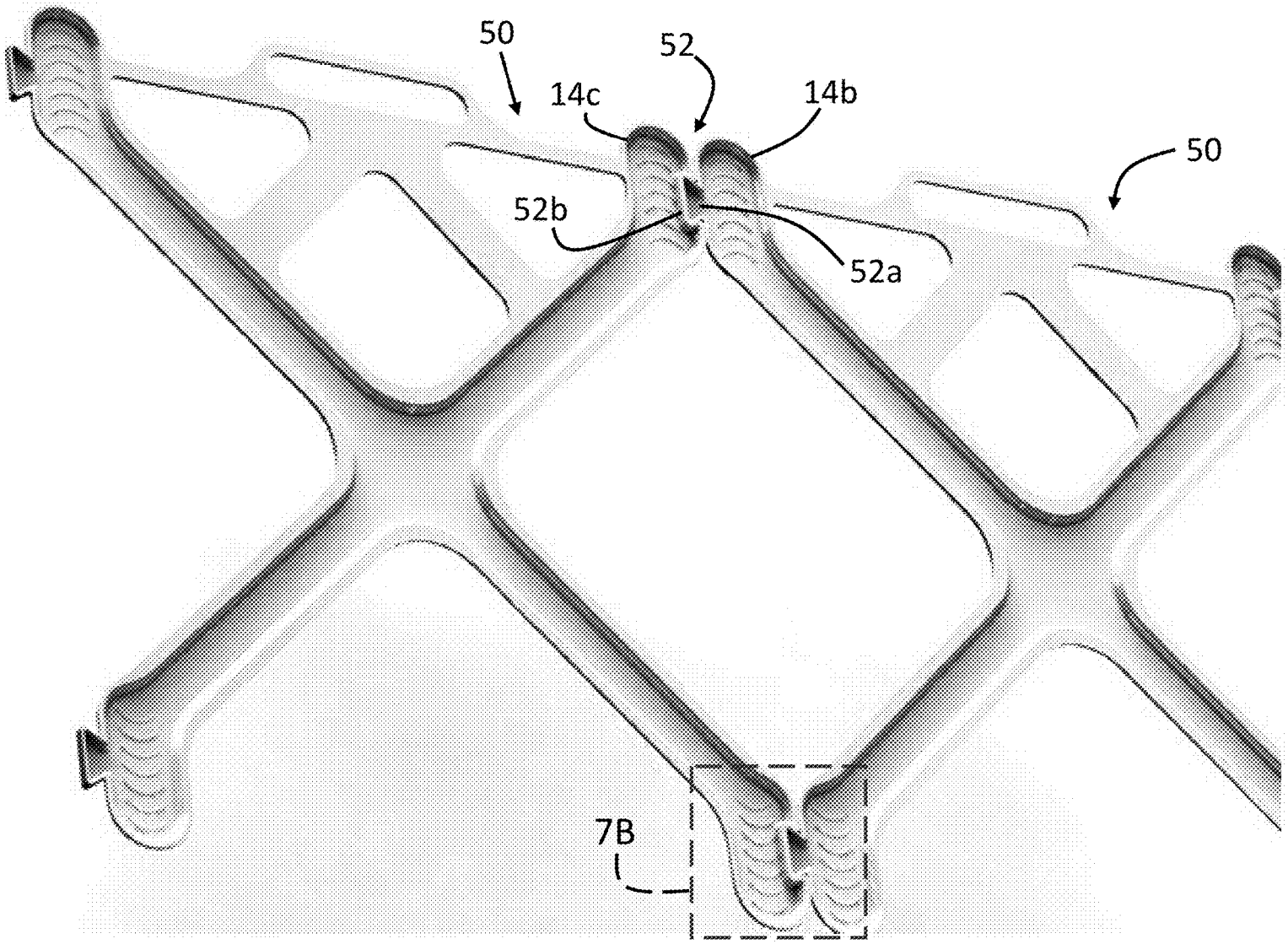
FIG. 7A is a perspective view of an embodiment of joined platforms in accordance with the invention.
Figure 7B:
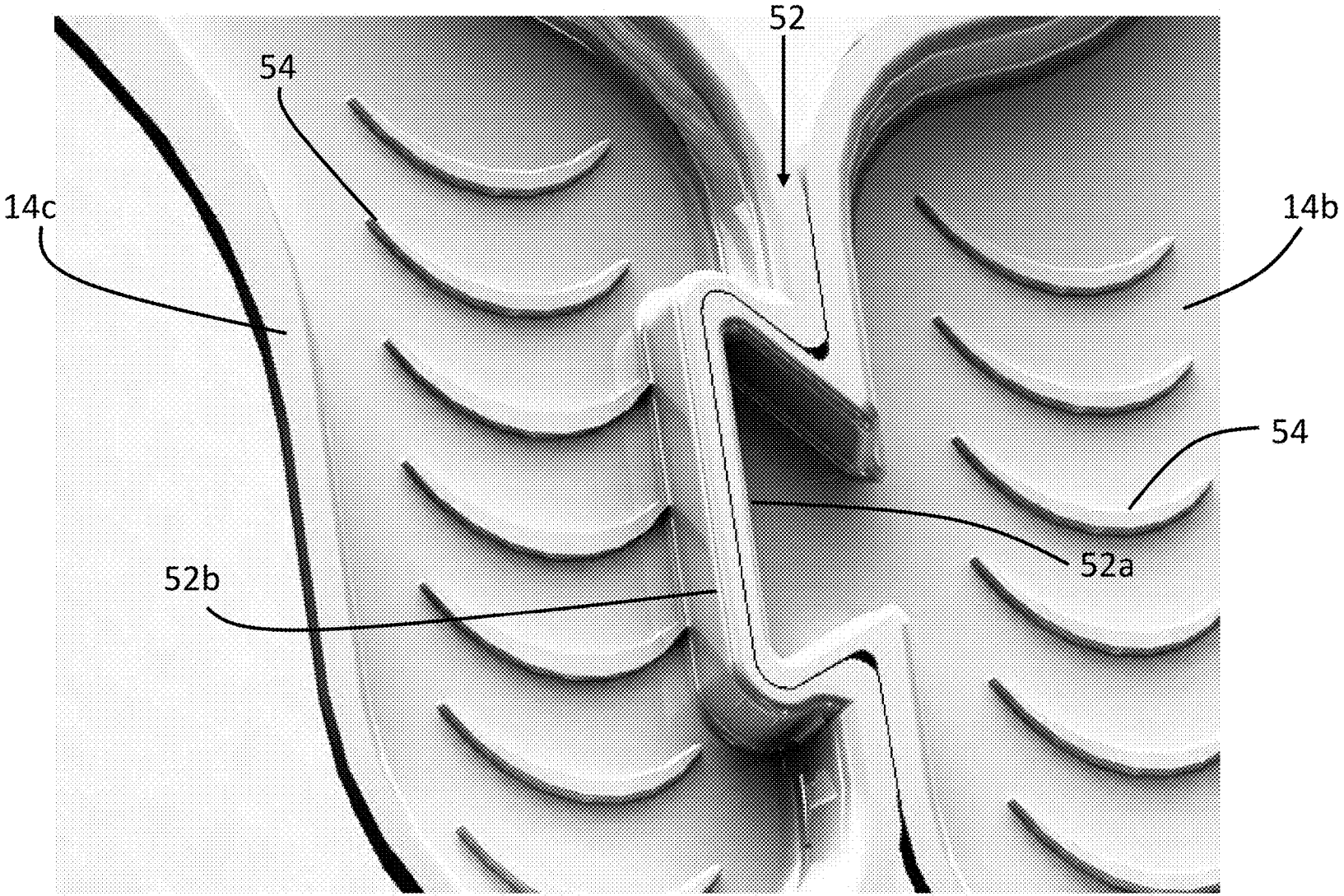
FIG. 7B is an enlarged view of the joined platforms of FIG. 7A.

Referring now to FIGS. 7A and 7B, there is illustrated an embodiment of a platform 50 that is configured to attach to another platform to form a row, such as a row of arranged seating, or a larger furniture unit such as a table. The platform 50 includes fasteners 52, illustrated as mating dovetail projections 52*a* and dovetail recesses 52*b*. The illustrated embodiment shows the dovetail projection 52*a* extending from corner pocket 14*b* and the dovetail recess 52*b* extends into corner pocket 14*c*. Though shown on the sides of the corner pockets 14*b* and 14*c* to form lateral rows, the projections and recesses 52*a*, 52*b* may be positioned on the ends to form longitudinal rows or columns. Alternatively, they may be formed on both surfaces or at other suitable attachment points to link platforms together. As shown in FIG. 7B, corner pockets 14*b* include the projections and recesses 52*a*, 52*b* along with a textured surface 54 of the corner pockets to prevent a furniture leg from sliding within the pocket. The textured surface 54 be any pattern including dimples, arcs, chevrons, raised dots or nibs, etc.

Figure 8A:
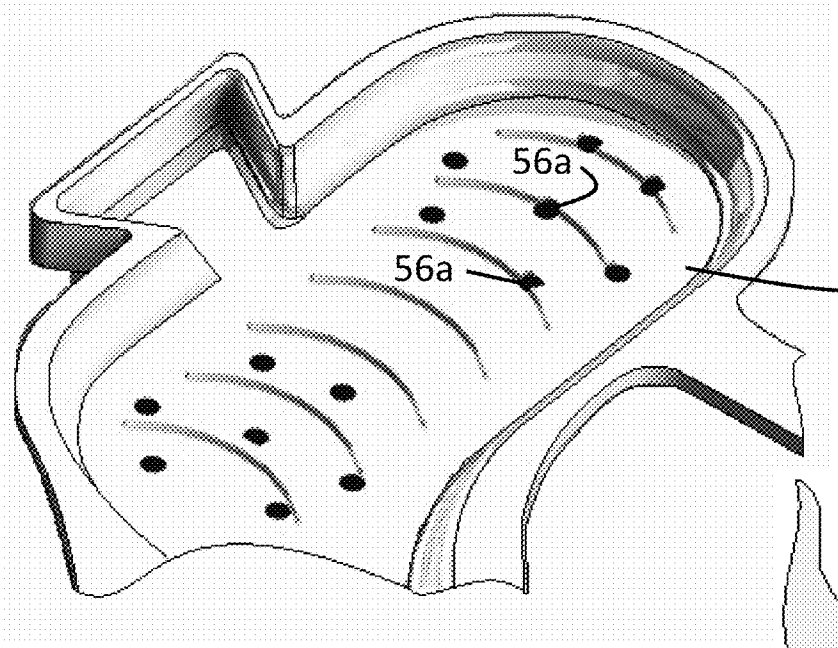
FIG. 8A is a perspective view of a top side of a corner pocket having a raised or textured surface to prevent leg movement.
Figure 8B:
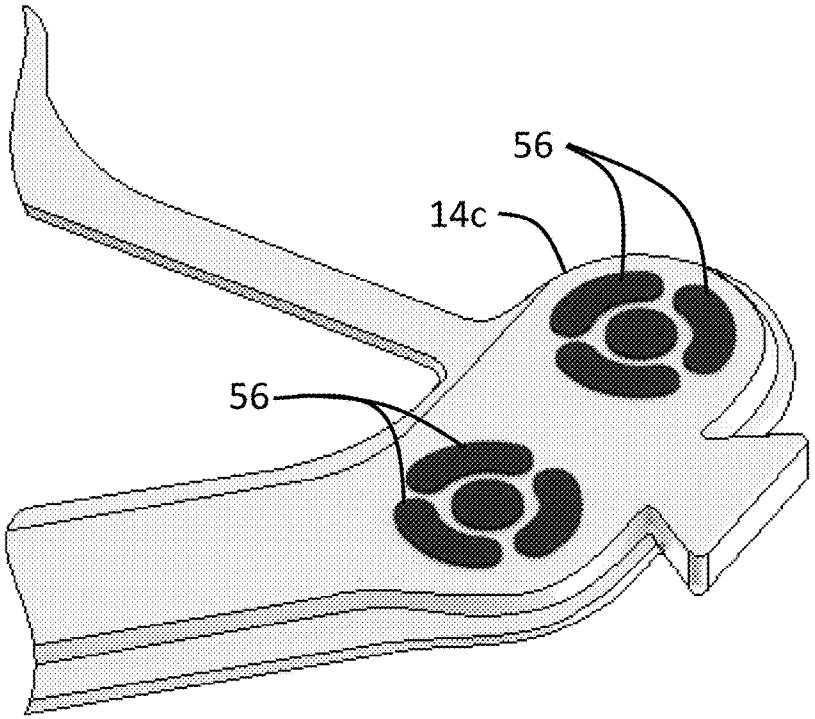
FIG. 8B is an underside view of the corner pocket of FIG. 8A with a non-skid pad for flooring applications.

Referring to FIGS. 8A and 8B, corner pockets 14*c* may include cushioning pads 56 on the foundation surface side, which can be formed of a friction enhancing or protective material, such as rubber, foam, or felt, to provide grip and/or prevent marring of a floor or court surface. The cushioning pads 56 may be applied to the undersurface 22 of the corner pockets 14*c* by an adhesive, molded onto the surface 22, or attached by way of projection barbs that extend through holes 56*a* formed through the corner pockets.

Referring now to FIGS. 9A-9E, there are illustrated various embodiments of a support platform, configured to support larger furniture units, such as tables, and accommodate different sizes of furniture units.

Figure 9A:
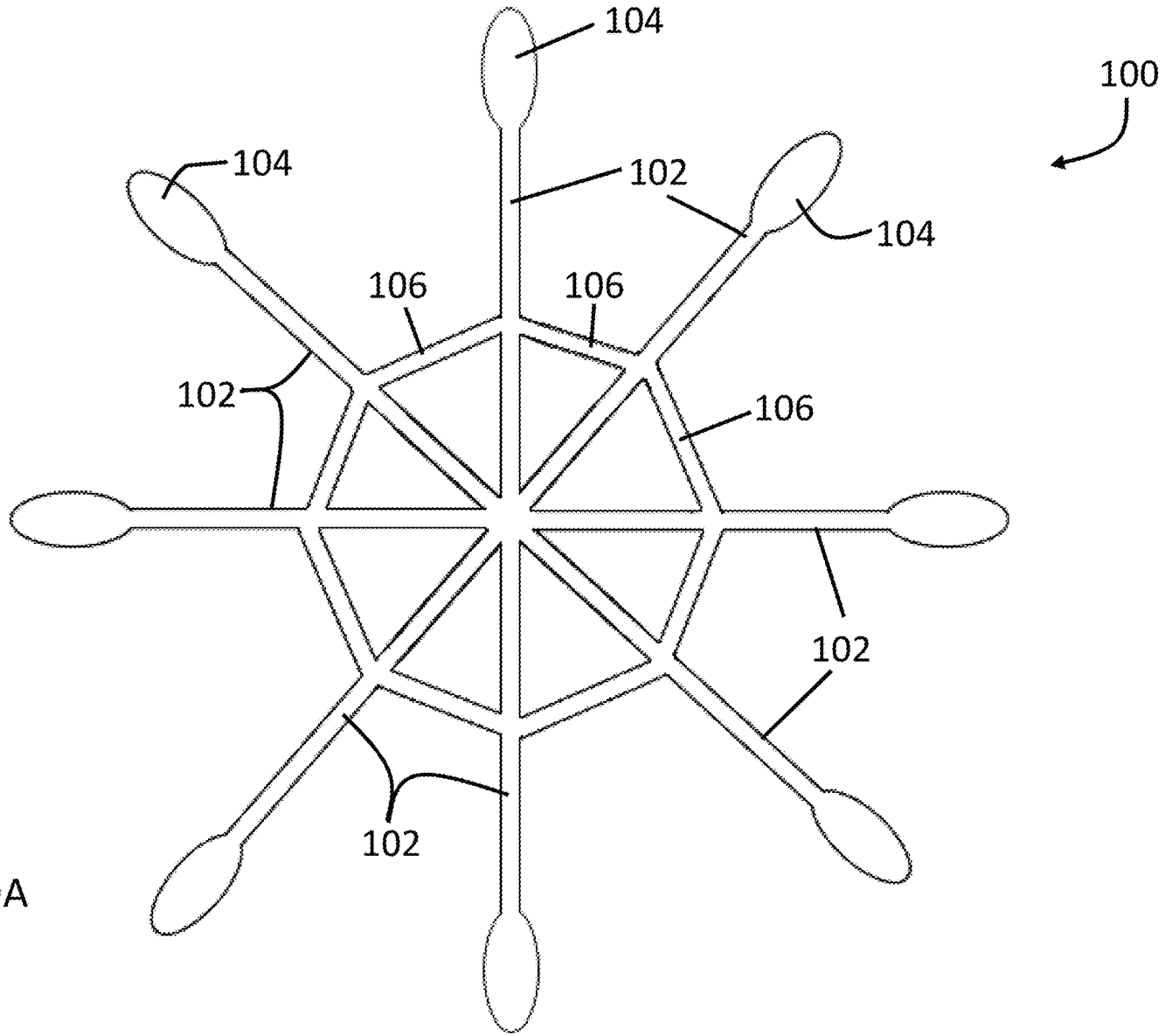
FIG. 9A is a plan view of an embodiment of a support platform having an alternative arrangement of corner pockets and cross members to support a circular or octagonal furniture piece, such as a table.
Figure 9B:
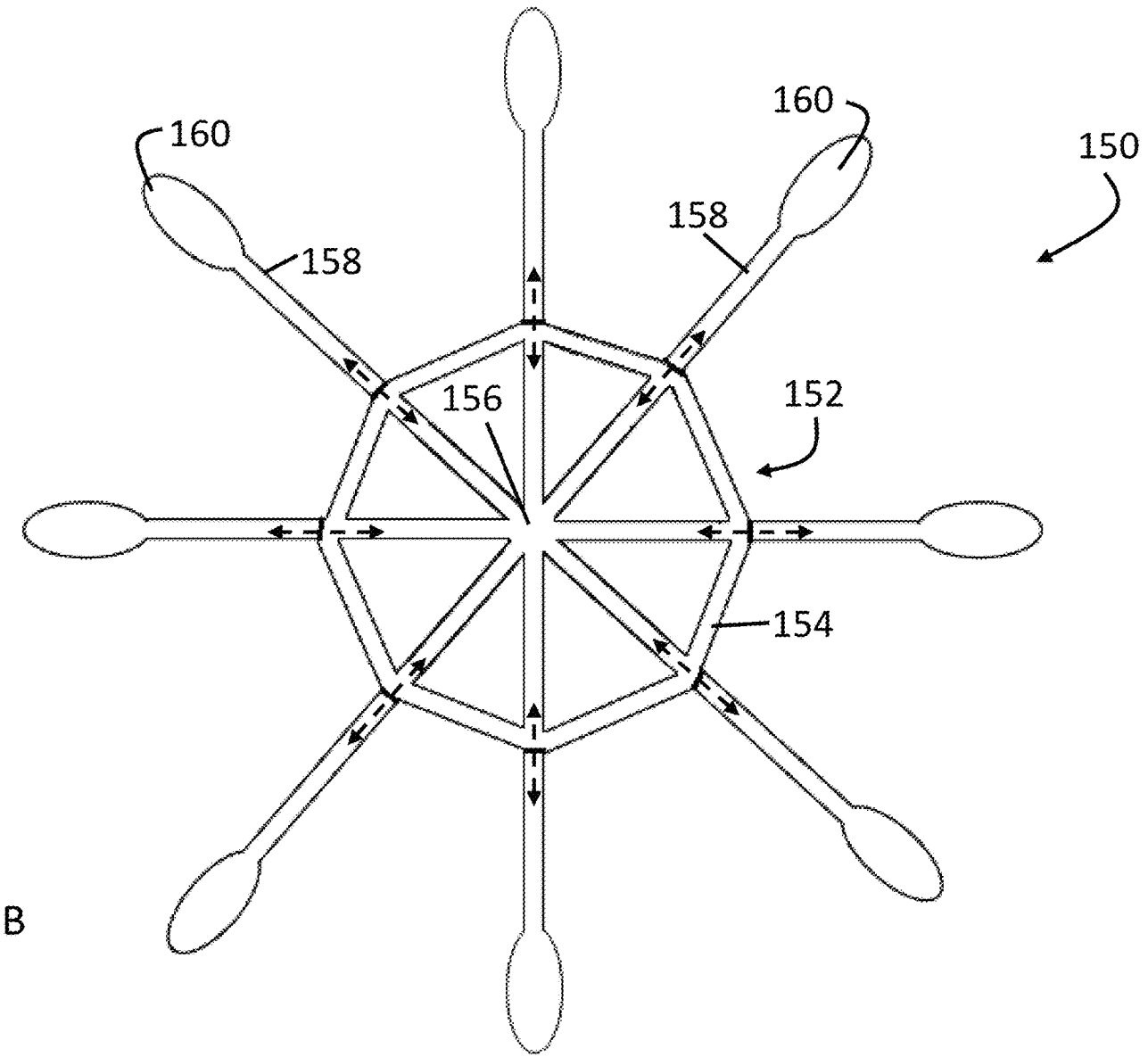
FIG. 9B is a plan view of an embodiment of a support platform, similar to FIG. 9A, and having length adjustable arms and corner pockets.

FIG. 9A illustrates an embodiment of a support platform, shown generally at 100, configured to support a furniture unit, such as a table, having an even or odd number of contact points or legs. Arms 102 may be arranged in any pattern or configuration to support the furniture contact points. The arms 102 terminate in support pockets 104 and may be interconnected by optional reinforcements, such as stiffening members 106. The arms 102 and support pockets 104 are configured with gussets similar to gussets 18 described in conjunction with the chair embodiments. In the embodiment of FIG. 9A, the arms 102 and any stiffening members are formed together as a single unit. As disclosed above in conjunction with the embodiment of FIG. 6, a hinge member may be applied to fold the support platform 100 in half or may be provided at each arm to fold the structure into a smaller geometric shape.

As shown in FIGS. 9B-9E, there are illustrated exemplary embodiments of adjustable platforms where the support arms may telescope inwardly and/or outwardly or be arranged in any desired number and angularly oriented to align with the furniture contact points. An adjustable platform 150, shown in FIG. 9B, includes a center section 152 having spokes 154 extending from a hub 156. The spokes 154 may be hollow or may have a formed shape, such as a dovetail cross section, to accept a telescoping or slidable support arm 158 terminating in a support pocket 160. Features of the embodiments described above, such as gussets, stiffening members, and/or cushioning pads, may be incorporated into any of the other embodiments as so desired.

Figure 9D:
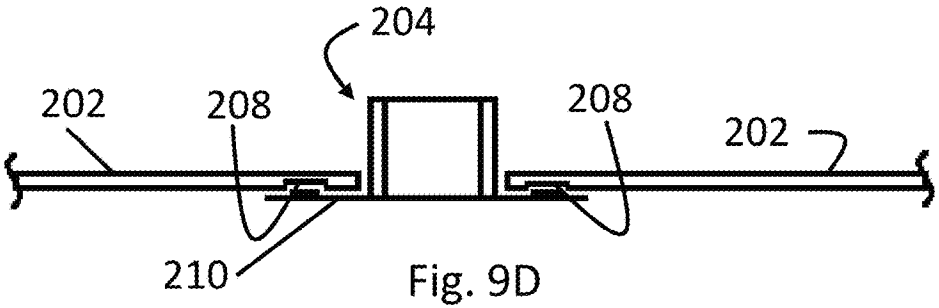
FIGS. 9C-9E are views of an embodiment of a support platform having angularly adjustable and replaceable arms and corner pocket structures.
Figure 9E:
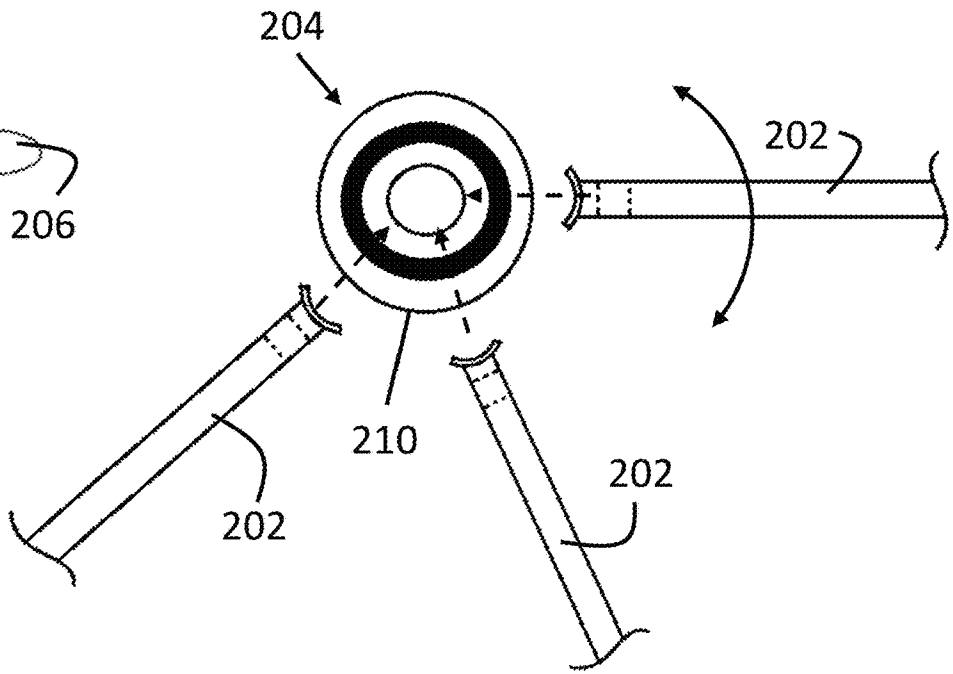
Figure 9C:
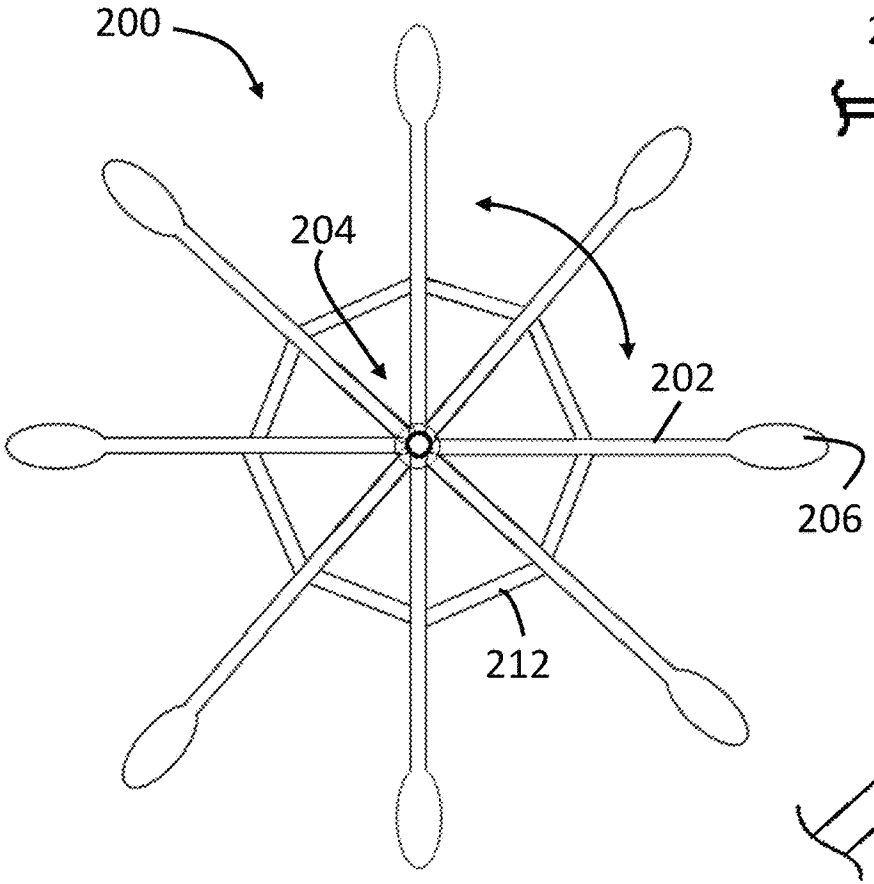

Referring to FIGS. 9C-9E, a support platform 200 is illustrated as a table support, though any other configuration for specific furniture pieces may be contemplated. The support platform 200 includes a plurality of support arms 202 that are arrangeable and connected to a mounting hub 204. The arms 202 include support pockets 206 at a proximal end and may be configured with attachment detents 208 that mate with projections extending from a corresponding locking ring 210 around the mounting hub 204, as shown in FIGS. 9D and 9E. These arms 202 may be placed in any desired number and spacing around the hub 204 to fit an intended furniture unit such as a table. The arms 202 may be additionally secured or stabilized with connecting elements 212 that engage, clip to, or are affixed to the arms 202 to maintain the spatial relationship relative to the furniture unit.

Figure 10:
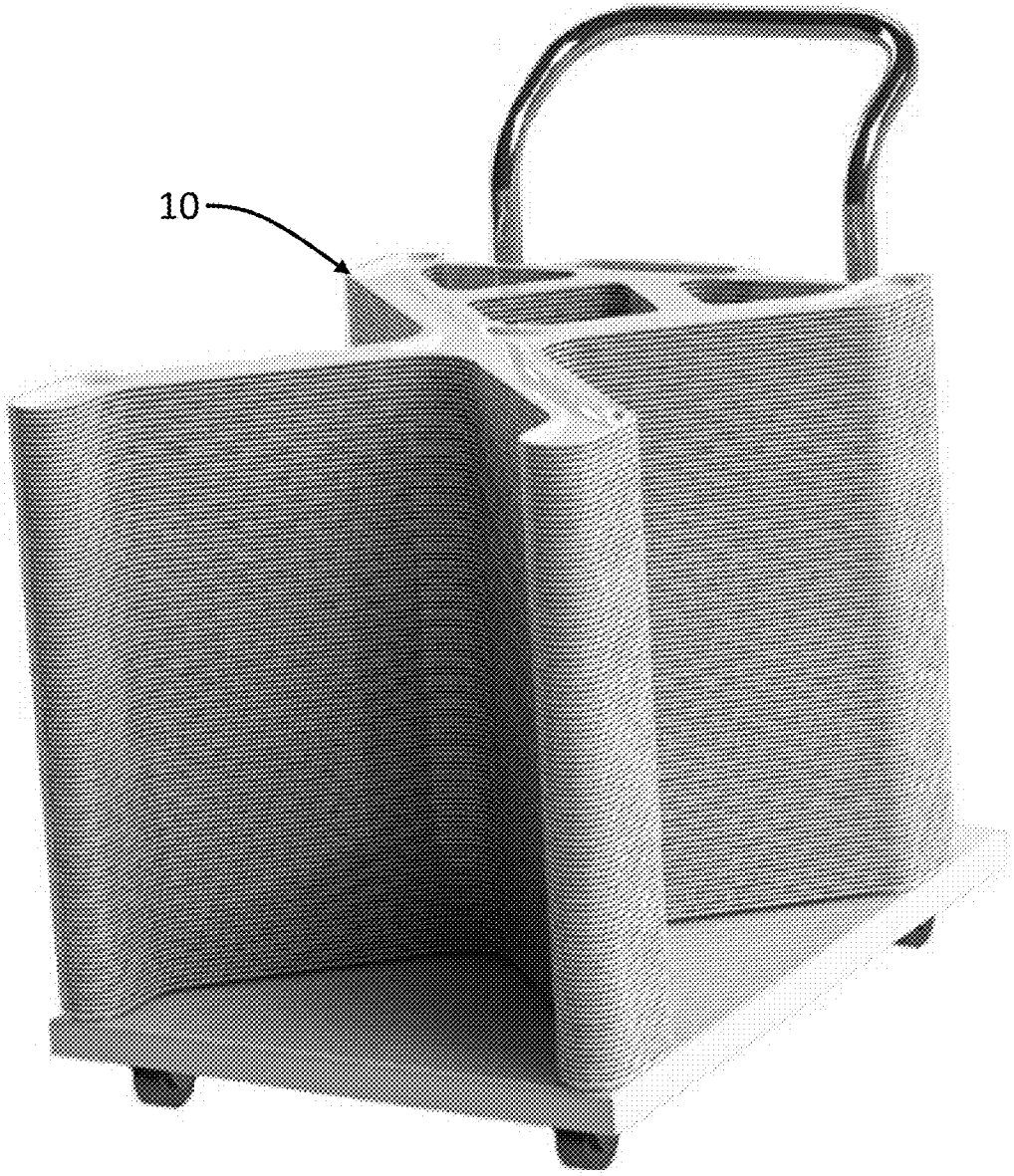
FIG. 10 is a perspective view of a plurality of stacked platforms.
Figure 11:
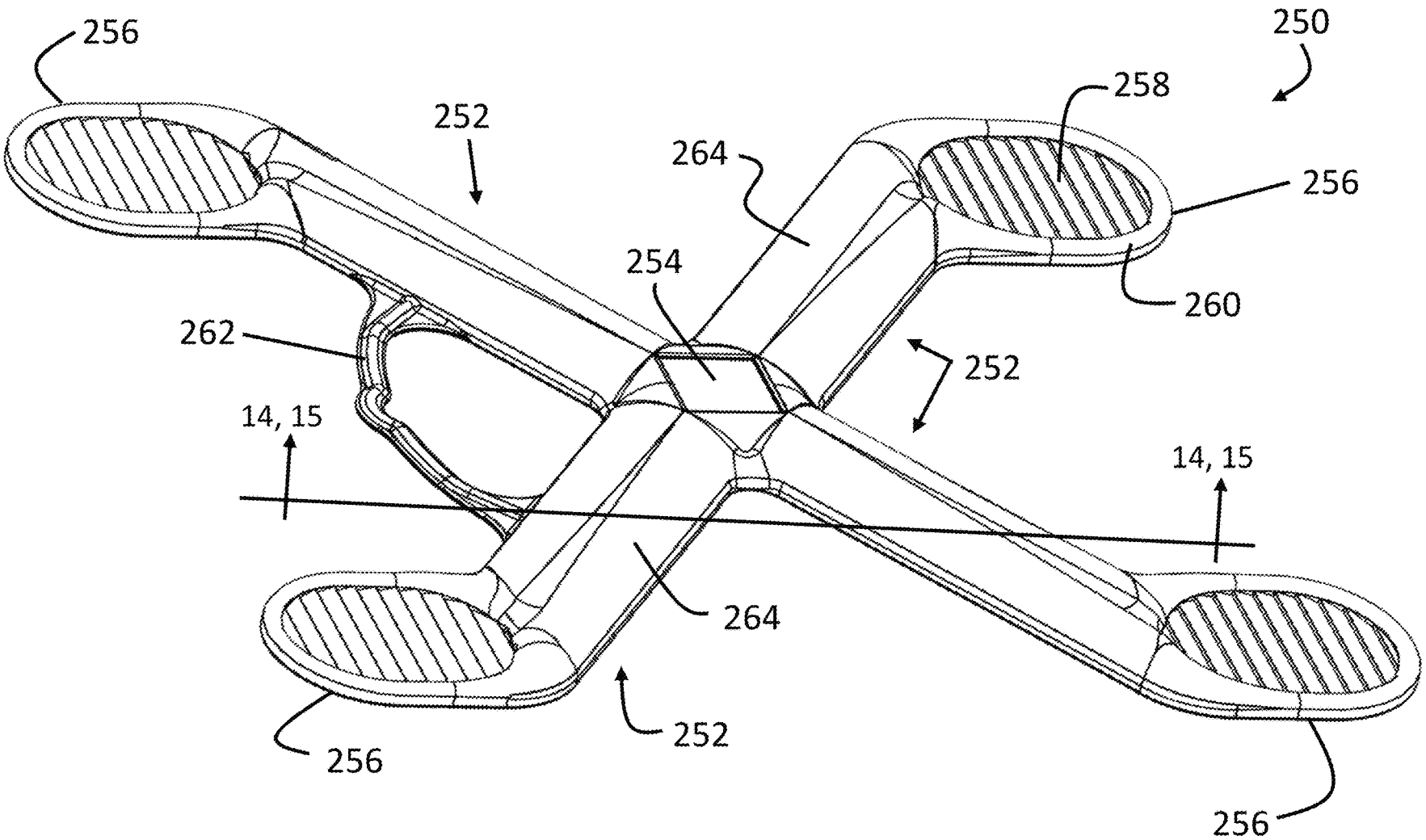
FIG. 11 is a perspective view of another embodiment of a support platform in accordance with the invention.
Figure 12:
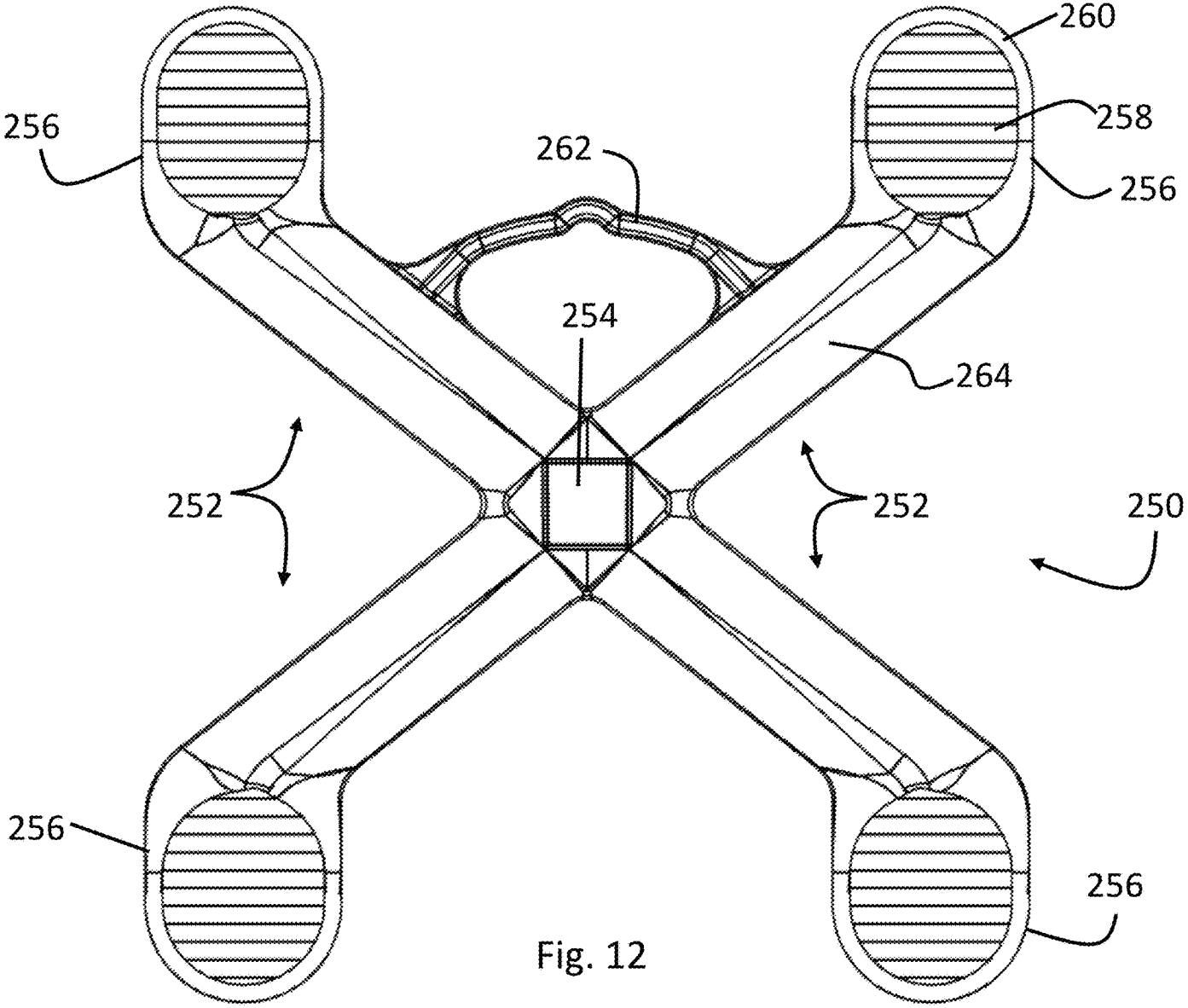
FIG. 12 is a top side, plan view of the support platform of FIG. 11.

As shown in FIG. 10, the platforms disclosed herein may be stacked for stable and convenient transport and storage.

Referring now to FIGS. 11-15, there is illustrated another embodiment of a furniture support platform, shown generally at 250. The support platform is illustrated in a chair support configuration; however, the platform and its construction may be applied to other furniture configurations. The platform 250 includes support arms 252 extending from a central hub 254. The arms 252 terminate in corner pockets 256 having a textured surface 258 and a pocket rim 260 extending around the pocket outer perimeter. The textured surface 256 is illustrated as a stepped or louver-like structure. An optional handle 262 extends between two adjacent arms 252. The handle 262 is more flexible in either material or geometry than the arms 252 to permit deflection from loads without cracking or breaking.

Figure 13:
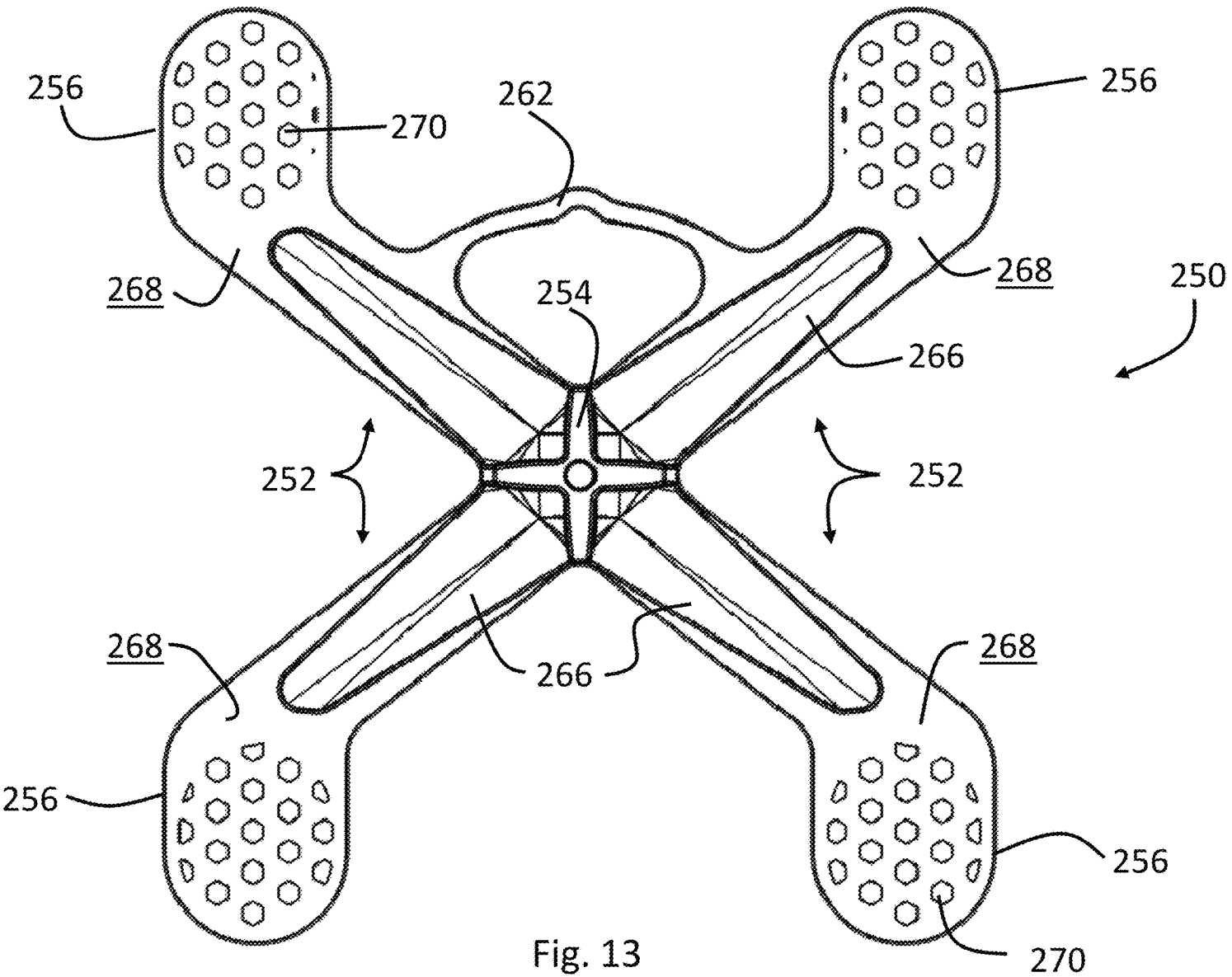
FIG. 13 is a bottom side, plan view of the support platform of FIG. 11.
Figure 14:
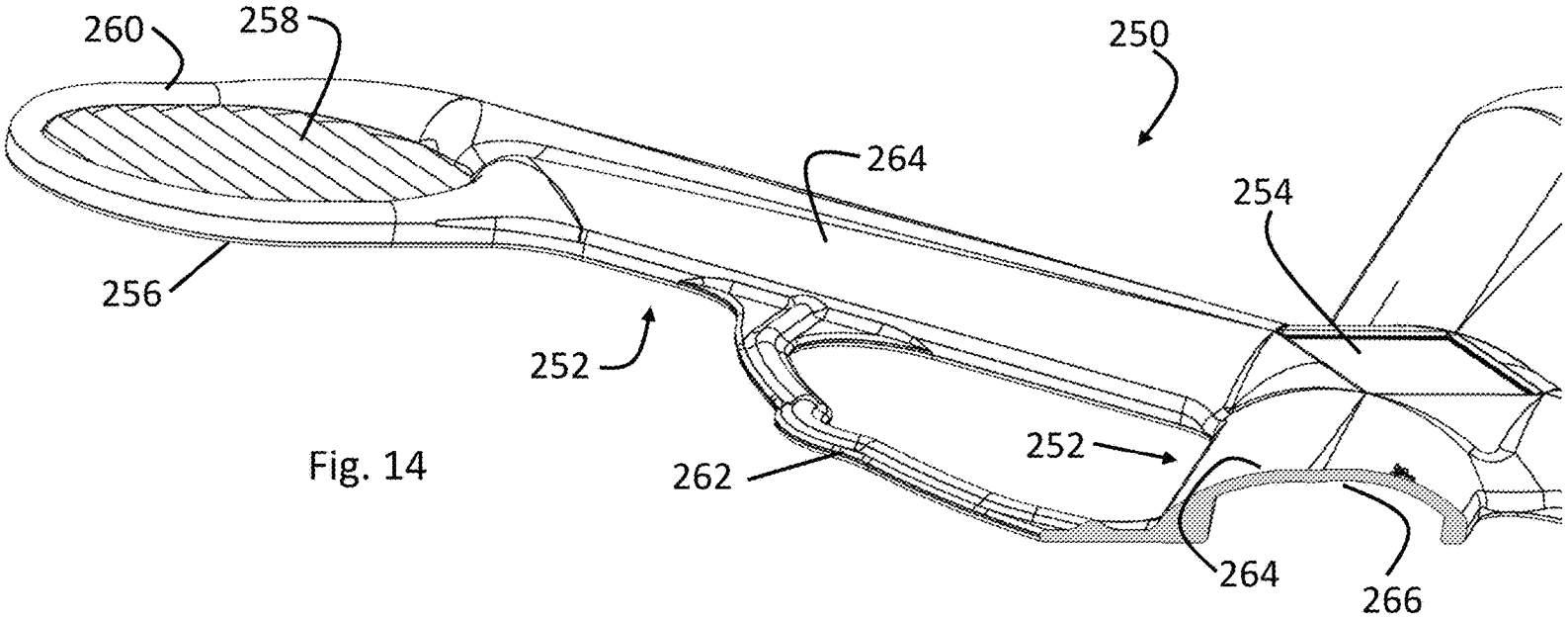
FIG. 14 is a top side, perspective, cross sectional view of the support platform of FIG. 11.
Figure 15:
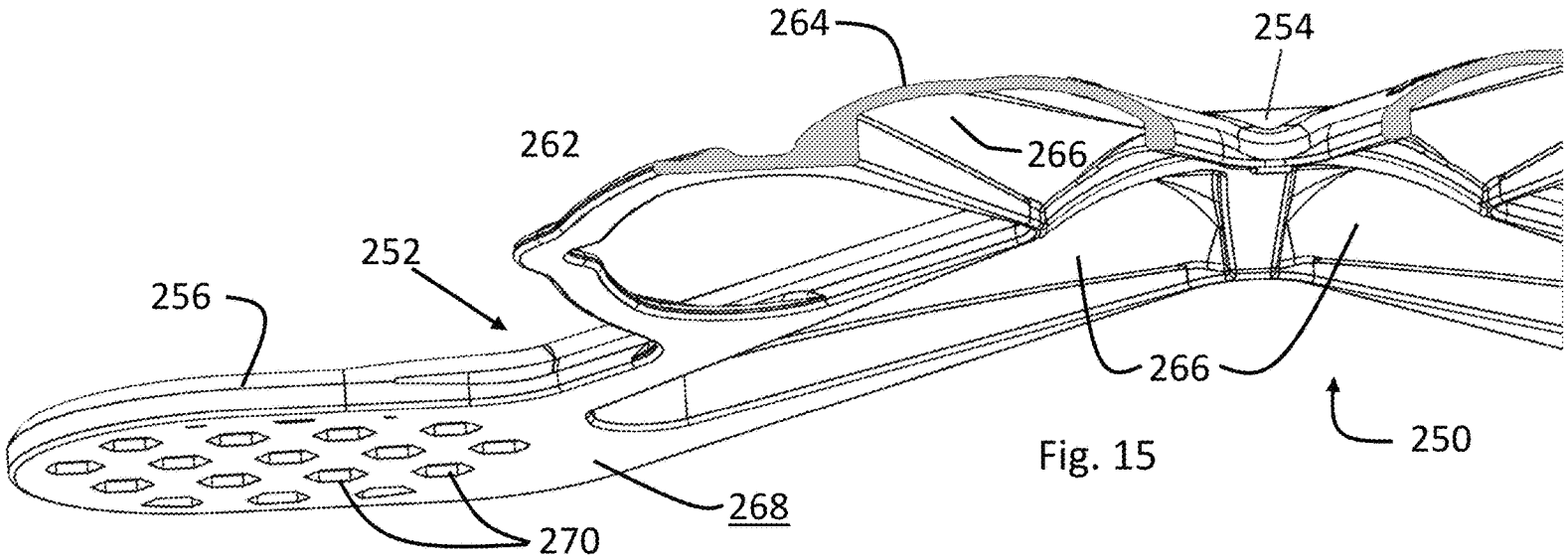
FIG. 15 is a bottom side, perspective, cross sectional view of the support platform of FIG. 11.

The arms 252 define an upper surface 264 having a crowned or arched profile that increases bending stiffness. Alternatively, the upper surface 264 may have a flat section rather than an arch or crown. The upper surface 264 creates a hollow or arched section 266 as shown in FIG. 13. A foundation surface 268 extends from the corner pocket 256 toward the central hub 254 along each support arm 252. As shown in the cross sectional views of FIGS. 14 and 15, the arms 252 define the hollow or arched section 266 extending from the central hub 254 to the corner pockets 256 and generally outlined by the foundation surface 268. The arched section 266 provides bending stiffness to the arms 252 to support the chair and user weight and spread the load over a larger surface area of the support surface such as turf or a floor. The arched surface reduces weight and material used to form the platform 250. The corner pockets 256 may include an underside surface texture 270, shown in FIGS. 13 and 15 as inwardly projecting recesses. Alternatively, the underside surface texture may be outwardly extending cleats or projections if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A furniture support platform comprising:

a plurality of support arms extending from a central point, the plurality of support arms each terminating in a corner pocket configured to support a furniture leg;

an upper surface; and a foundation surface opposite the upper surface and configured to support an article of furniture on a base surface; wherein each support arm includes an arched section that defines a hollow section on a bottom side of the support arm that is outlined by the foundation surface on opposite sides of the hollow section and that extends along a portion of the support arm between the corner pocket and the central point, wherein the portion of the foundation surface that outlines the hollow section engages the base surface.

2. The furniture support platform of claim 1 wherein the arched section provides bending stiffness to the support arms and spreads weight over the base surface.

3. The furniture support platform of claim 2 wherein the base surface is one of a natural grass surface, an artificial turf surface, or a sandy surface.

4. The furniture support platform of claim 1 wherein a reinforcement cross section of the plurality of support arms is a perimeter gusset extending around the plurality of support arms and defining the upper surface.

5. The furniture support platform of claim 4 wherein the perimeter gusset is a plurality of generally concentric reinforcing gussets configured to resist bending of the support arms.

6. The furniture support platform of claim 4 wherein the perimeter gusset is a generally straight wall extending from or extending adjacent to the upper surface.

7. The furniture support platform of claim 5 wherein the perimeter gusset terminates in flange.

8. The furniture support platform of claim 4 wherein a stiffening member is connected between adjacent support arms.

9. The furniture support platform of claim 8 wherein the stiffening member defines a handle.

10. The furniture support platform of claim 1 wherein a cross section of each support arm is an arched profile.

11. The furniture support platform of claim 10 wherein the foundation surface extends along a perimeter of the plurality of support arms.

12. The furniture support platform of claim 1 wherein the plurality of support arms are length adjustable; or the central point is a hub that attaches to the plurality of support arms; or the plurality of support arms are angularly moveable about the hub.

13. The furniture support platform of claim 1 wherein the corner pockets include one or more cushioning pads.

14. A furniture support platform comprising:

a plurality of support arms extending from a central point, the plurality of support arms each terminating in a corner pocket configured to support a furniture leg;

an upper surface;

a foundation surface opposite the upper surface and configured to support an article of furniture on a base surface and engage the base surface to limit movement of the support platform with respect to the base surface; and a protrusion extending downward from the central point, wherein each support arm includes a hollow section on a bottom side thereof that extends to the protrusion.

15. The furniture support surface of claim 14 wherein the base surface is one of a turf structure or a sand structure and the stiffness characteristic resists deflection of the corner pockets into the base surface.

16. The furniture support surface of claim 14 wherein a handle extends between two adjacent support arms and defines a gap between the handle, the two adjacent support arms and the central point that is sized to receive a hand, the handle having greater flexibility than provided by the stiffness characteristic.

17. The furniture support surface of claim 14 wherein the upper surface defines one of an arch, a crown, or a flat surface, and the foundation surface extends around a perimeter of the support arms and defines a hollow section under the upper surface.

18. The furniture support platform of claim 14 wherein the corner pockets include fasteners that permit one furniture support platform to be connected to an adjacent furniture support platform.

19. The furniture support platform of claim 18 wherein the fasteners are configured as mating dovetail projections and recesses.

20. The furniture support surface of claim 14 wherein a tiedown is connected between one of a handle, a stiffening member, or a support arm and the article of furniture to prevent separation therebetween.

21. The furniture support platform of claim 1 wherein the foundation surface under at least one of the corner pockets is textured for engagement with the base surface.

22. The furniture support platform of claim 1 wherein the foundation surface under at least one of the corner pockets has a cleat for engagement with the base surface.

23. The furniture support platform of claim 1 wherein the upper surface of the corner pocket includes a textured base surface configured to engage the bottom of the furniture leg.

24. The furniture support platform of claim 23 wherein the textured base surface of the corner pocket does not extend vertically above the central point.

25. The furniture support platform of claim 14 wherein the foundation surface under at least one of the corner pockets is textured for engagement with the base surface.

26. The furniture support platform of claim 14 wherein the foundation surface under at least one of the corner pockets has a cleat for engagement with the base surface.

27. The furniture support platform of claim 14 wherein the upper surface of the corner pocket includes a textured base surface configured to engage the bottom of the furniture leg.

28. The furniture support platform of claim 27 wherein the textured base surface of the corner pocket does not extend vertically above the central point.

29. A furniture support platform comprising:

a plurality of support arms extending from a central point, the plurality of support arms each terminating in a corner pocket configured to support a furniture leg, wherein the support arms extend upward from the corner pockets to the central point such that the central point is vertically higher than the corner pockets;

an upper surface; and a foundation surface opposite the upper surface and configured to support an article of furniture on a base surface, wherein the foundation surface under at least one of the corner pockets is configured to engage the base surface to limit movement of the support platform with respect to the base surface.

30. The furniture support platform of claim 29 wherein the foundation surface under at least one of the corner pockets has a cleat for engagement with the base surface.

31. The furniture support platform of claim 29 wherein the upper surface of the corner pocket includes a textured base surface configured to engage the bottom of the furniture leg.

32. The furniture support platform of claim 31 wherein the textured base surface of the corner pocket does not extend vertically above the central point.

33. The furniture support surface of claim 29 wherein a handle extends between two adjacent support arms and defines a gap between the handle, the two adjacent support arms and the central point that is sized to receive a hand.

* * * * *